United States Patent [19]

Sandell

[11] Patent Number: 4,551,794

[45] Date of Patent: Nov. 5, 1985

[54] IMITATION CANDLE WITH MAGNETIC PENDULUM

[76] Inventor: Sven Sandell, Kälkbacksgatan 5, Jönköping, Sweden

[21] Appl. No.: 652,032

[22] Filed: Sep. 19, 1984

[30] Foreign Application Priority Data

Sep. 21, 1983 [SE] Sweden ..... 8305081

[51] Int. Cl.[4] ..... F21V 23/00

[52] U.S. Cl. ..... 362/392; 362/810

[58] Field of Search ..... 362/810, 392, 811, 21, 362/212, 411

[56] References Cited

U.S. PATENT DOCUMENTS

| | | | |
|---|---|---|---|
| 3,500,126 | 3/1970 | Ford | 362/810 |
| 4,328,534 | 5/1982 | Abe | 362/392 |

FOREIGN PATENT DOCUMENTS

| | | | |
|---|---|---|---|
| 2000120 | 8/1969 | France | 362/392 |
| 627919 | 11/1961 | Italy | 362/810 |
| 634497 | 2/1962 | Italy | 362/810 |

*Primary Examiner*—Carl Stuart Miller

*Attorney, Agent, or Firm*—Sughrue, Mion, Zinn, Macpeak and Seas

[57] ABSTRACT

An imitation candle includes an elongated outer candle-casing (43), having located at one end thereof an electric light bulb (1) carried on one end of a pendulum. The other end of the pendulum carries a counterweight (18) comprising, at least in part, a permanent magnet (21). The pendulum is mounted on two wire-like elements (15) extending in a common plane from a common connector (11) on the pendulum. The ends of the wire-like elements remote from one another are anchored in a holder (23) located around the pendulum. The poles of the permanent magnet (21) lie on a line extending at right angles to the longitudinal axis of the pendulum. The two wire-like elements (15) extending from the common connector (11) in diametrically opposite directions preferably form conductors (3,4) leading to the electric light bulb.

5 Claims, 6 Drawing Figures

IMITATION CANDLE WITH MAGNETIC PENDULUM

BACKGROUND OF THE INVENTION

The invention relates to an imitation candle comprising an elongated outer candle-casing having located at one end thereof an electric light bulb which is attached to one end of an elongated pendulum and which is balanced by a counterweight made totally or partially of a magnetic material and attached to the opposite end of the pendulum, the pendulum being pivotally mounted on pivot means at a location between the two ends of the pendulum, and which further comprises an electromagnet which is placed beneath the counterweight and which is arranged to receive periodically an electric current so as to generate an electromagnetic field which acts upon the counterweight.

Such an imitation candle is described, for example, in the published International Patent Application (PCT) WO 82/02756 and DE 3037706 A1. A common feature of all known candles or lamps of the kind described is that the pendulum suspension and pivot means comprises a coil spring which embraces the pendulum. This coil spring supports the weight of the bulb, the pendulum and the counterweight, and is also intended to allow the pendulum to swing in all directions. The counterweight comprises a magnetizable material and is drawn down towards a periodically magnetised electromagnet. When the counterweight is attracted towards the electromagnet, the spring is compressed in the direction of its longitudinal axis. When the electromagnetic field ceases to act on the counterweight, the counterweight, together with the pendulum and the light bulb are pushed upwards by the coil spring, in what can be referred to as a "rocking" movement. This downward and upward movement of the light bulb in no way corresponds to the flickering or fluttering movement of a candle flame, and the lamp therefore gives but a poor illusion of a real candle. The most serious disadvantage with such an arrangement, however, is that sooner or later the spring is weakened and, as a result, the counterweight strikes against the electromagnet with an irritating clicking sound. In addition, the force exerted by the spring does not normally act in a true vertical direction, causing the bulb to be obliquely positioned and therewith further impairing the desired effect of imitating a candle flame.

SUMMARY OF THE INVENTION

Consequently, a prime object of the invention is to provide an imitation candle of the aforedescribed kind in which the aforesaid downward and upward movement of the pendulum is either fully excluded or kept to a minimum, and in which the pendulum swings about an axis which extends substantially at right angles to the longitudinal axis of the pendulum.

BRIEF DESCRIPTION OF THE DRAWINGS

This object is fully realised with the arrangement defined in the following claims and hereinafter described with reference to the accompanying drawings, in which

DETAILED DESCRIPTION OF THE PREFERRED EMBODIMENTS

Figure 1:
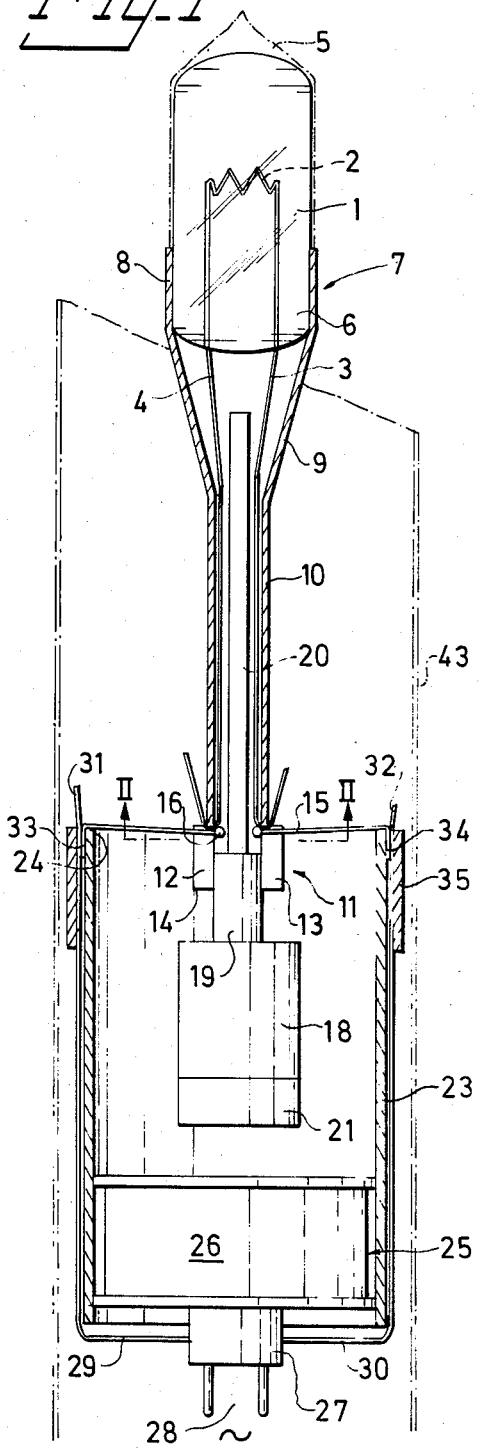
FIG. 1 is a simplified illustration of an embodiment of the invention.

In FIG. 1 there is shown an electric light bulb 1 having a glass envelope which is evacuated or filled with gas and which has an electric filament 2 arranged therein. The filament 2 includes elongated electrical conductors 3 and 4 respectively, over which a voltage is applied to the filament. The glass envelope may have the shape of a candle flame, or alternatively can be housed in a lamp casing of suitable configuration, as illustrated at 5. The illustrated bulb 1 has a base part 6 which is inserted into an upwardly open cup-shaped bulb holder 7. In the illustrated embodiment, the holder 7 has an upper cylindrical part 8 which tightly embraces the base part 6 of the bulb 1 and holds the bulb in position by friction. It is, of course, also possible to bond the base part 6 firmly to the cup-shaped holder 7.

Figure 2:
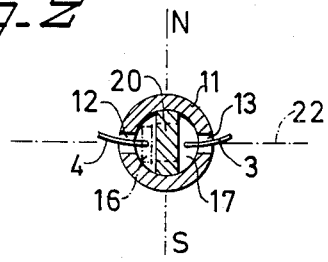
FIG. 2 is a sectional view taken on the line II—II in FIG. 1, with the suspension elements omitted for the sake of clarity.
Figure 3:
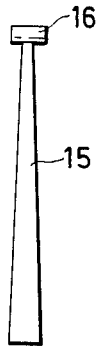
FIG. 3 illustrates a suspension element made of an electrically conductive rubber material and used in the arrangement illustrated in FIG. 1.

The cylindrical part 8 of the holder 7 joins with a conical part 9, the pointed end of which merges with a narrow tube 10. Arranged on the lower end of the tube 10 is a connector 11. The connector 11 has the form of a cylindrical annulus having two diametrically opposed grooves 12 and 13 which extend from the lower edge surface 14 of the connector 11 up to the narrow tube 10. As hereinafter made more apparent, the continuous body 7, 10, 11 forms a pendulum. The two electrodes or conductors 3,4 of the light bulb, said electrodes in the illustrated embodiment being bare and void of an external insulation, are drawn down through the interior of the bulb holder 7, through the tube 10 and out through respective grooves 12 and 13, and folded upwardly around the edges of said grooves in a manner to hold the bulb in the holder 7. Subsequent to inserting the bulb 1 into the bulb holder 7 and placing the conductors in the respective grooves 12,13 in the aforedescribed manner, wire-like elements for supporting the pendulum are mounted in position. One such element 15 is illustrated in FIG. 3 and comprises a head 16 and a wire-like or strip-like stem. The element is made of an electrically conductive rubber material, for example, silicon rubber containing carbon particles, and the head of said element is located radially inwardly of the groove 12. The width or diameter of the head 16 is such that when inserted into the inner cavity 17 (FIG. 2) of the connector 11, the head 16 of said element 15 lies against the inner defining wall of the connector 11, thereby preventing the element from sliding out through the groove 12. The position of the head 16 behind the groove 12 is shown in broken lines in FIG. 2. The stem of the wire-like element 15 extending from the head 16 thus lies externally of the annular connector 11. A further wire-like element 15 is placed in the groove 13 located diametrically opposite the groove 12. The two heads 16 lie pressed against the un-insulated bulb electrodes 3 and 4, thereby to provide an electrical connection between the electrodes 3 and 4 and respective wire-like elements 15. The illustrated arrangement also includes a counterweight 18 having a neck 19 on which there is mounted an elongated insulating rod 20. Subsequent to the electrodes or conductors 3 and 4 and the wire-like elements 15 having been assembled in the aforedescribed manner, the rod 20 is inserted into the hollow interior of the tube 10 and there forms a positive insulating barrier between the electrodes 3 and 4. In the FIG. 2 embodiment the rod 20 has a rectangular cross-sectional shape, and suitably extends completely through the tube 10 and projects slightly into the bulb holder 7. As will be seen from FIG. 2, the rod 20 of the illustrated embodiment has two mutually opposing surfaces which abut the inner wall of the tube 10 in a manner to positively hold the rod firmly in the tube, therewith also to hold the counterweight 18 in its intended position. The illustrated counterweight 18 has provided at the lower end thereof a permanent magnet 21. As beforementioned, the respective heads 16 of the two wire-like elements 15 have diametrically opposed locations on the annular connector 11 and are extended outwardly in a common plane 22, FIG. 2, towards and over the edge of a sleeve 23 which partially encircles the counterweight 18 and the pendulum. The upper edge 24 of the sleeve 23 lies in a plane extending at right angles to the longitudinal axis of the sleeve. As will be seen from FIG. 1, the ends of the wire-like elements 15 are folded around said edge and in the assembled condition of the arrangement lie pressed against the outer surface of the sleeve 23, as described hereinafter.

Figure 6:
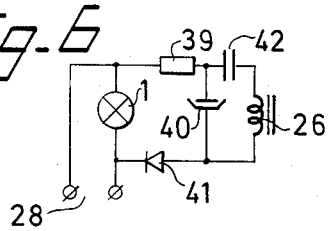
FIG. 6 illustrates by way of example an electronic circuit for activating periodically the electromagnet included in the arrangement.

The permanent magnet 21 lies above an electromagnet 25, having a coil 26 to which a voltage is periodically applied from an electronic circuit 27, as hereinafter described with reference to FIG. 6. The electronic circuit 27 is connected to mains voltage at 28 and has a supply conductor 29 and 30, for applying a voltage to the electric light bulb 1. These conductors 29 and 30 are drawn upwards along the outer surface of the sleeve 23 and are bare of insulation, at least at the end parts thereof lying in the vicinity of the upper edge 24 of the sleeve 23. The sleeve 23 of the illustrated embodiment is made totally of an electrically insulating material, preferably a plastics material. The upper end parts 31 and 32 of the two conductors 29 and 30 are brought into contact with the folded end parts 33 and 34 of the wire-like elements 15. To ensure electrically conductive contact of the non-insulated end parts of the conductors 29 and 30 with the electrically conductive wire-like elements 15, a ring 35 is pressed on the sleeve 23, in the manner illustrated in FIG. 1.

Figure 4:
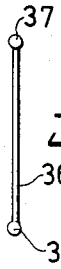
FIG. 4 illustrates a modified suspension element, also made of an electrically conductive rubber material.
Figure 5:
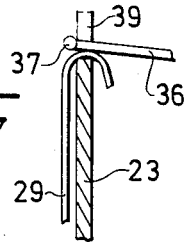
FIG. 5 illustrates a mode of attachment of the outer end of the suspension element according to FIG. 4.

FIG. 4 illustrates a modified wire-like element 36 having two heads 37 and 38. The head 38 is placed in a respective groove in the connector 11 in the aforedescribed manner, and the other, oppositely located head 37 is placed externally of the outer wall of the sleeve 23, against a groove 39 into which the conductor 29 has already been drawn, as illustrated in FIG. 5. Two wire-like elements 36 secured in the connector 11 and in the sleeve 23 respectively and lying in a straight line with one another will form a suspension means upon which the pendulum can pivot or swing. The wire-like elements 15 form a similar pivot means. The wire-like element 36 is also assumed to be made from an elastic rubber material of an electrically conductive kind, although it should be noted that the wire-like element 36 may also be made of an electrically conductive material, for example copper or a copper alloy. It is also possible to cause the conductors 29 and 30, particularly the end portions 31 and 32 of said conductors, to form the wire-like elements and to solder said end parts of the conductors to the conductors or electrodes 3 and 4. The only essential factor in this respect is that the conductor-portions located on both sides of the connector 11 and extending between the connector and the upper edge 24 of the sleeve 23 are uniformly tensioned and positively anchored. As will readily be understood, the pendulum with the light bulb 1 and the counterweight 18 are so balanced as to hang vertically in the absence of any force thereupon.

The periodic pulses which act upon the permanent magnet 21, can be supplied from any suitable known circuit. One such circuit is illustrated in FIG. 6 and includes an RC-circuit having a resistance 39, an electrolyte capacitor 40 and a diode 41 over which a diac 42 is activated periodically to send a voltage pulse to the coil 26, which during magnetization generates briefly a magnetic field within which the permanent magnet 21 is located. The poles of the permanent magnet are located at right angles, or at least substantially at right angles to the longitudinal axis of the pendulum, i.e. to the vertical axis of the pendulum when the pendulum hangs freely in the absence of any force thereupon. With such an arrangement, the permanent magnet 21, and thus the pendulum with light bulb 1, will execute a swinging movement about the centre of the connector 11, and the downward movement resulting in the disadvantages mentioned in the introduction is completely eliminated, or at least practically completely eliminated. The permanent magnet 21 is suitably positioned so that the north pole and south pole of the connecting line lies at right angles to the pivot axis 22, as indicated in FIG. 2. As shown in broken lines in FIG. 1 at 43, the aforedescribed arrangement is housed in an outer casing 43 having the shape and appearance of a candle body.

The illustrated embodiment of the invention has been selected solely by way of example, and can be widely modified within the scope of the following claims. For example, the described counterweight may itself comprise the permanent magnet.

I claim:

1. An imitation candle which comprises an elongated outer candle-like casing having located at one end thereof an electric light bulb (1) which is attached to one end of a pendulum and which is balanced by a counterweight (18) made totally or partially of a magnetic material and attached to the opposite end of said pendulum, said pendulum being pivotally mounted on pivot suspension means (15; 36) at a location between the two ends of said pendulum, and which further comprises an electromagnet (25) which is placed beneath the counterweight (18) and which is arranged to receive periodically an electric current so as to generate an electromagnetic field acting upon the counterweight, characterized in that said pivoting means comprises two wire-like elements (15, 36) which extend in a mutually common plane in mutually opposite directions from a common connector (11) on said pendulum, and the ends (33,34; 37) of said elements remote from the pendulum are firmly attached to a holder (23) surrounding the pendulum; and in that the counterweight (18) is supported by or consists of a permanent magnet (21) with the north pole and the south pole thereof lying on a line extending substantially at right angles to the longitudinal axis of the pendulum.

2. An imitation candle according to claim 1, characterized in that the wire-like elements (15, 36) comprise an electrically conductive rubber-like material and form connecting conductors leading to the filament (2) of the electric light bulb (1).

3. An imitation candle according to claim 1, characterized in that the wire-like elements (15, 36) comprise an electrically conductive metal.

4. An imitation candle according to claim 1 or claim 2, characterized in that the wire-like elements comprise the electrical conductors (3,4) leading to the filament (2) of the electric light bulb (1).

5. An imitation candle according to claim 1, characterized in that the two poles (N,S) of the permanent magnet (21) lie on a line which is at a right angle to a plane (22) containing both the two wire-like elements (15,36) and the longitudinal axis of the pendulum.

* * * * *